US007335842B2

(12) United States Patent
Guo et al.

(10) Patent No.: US 7,335,842 B2
(45) Date of Patent: Feb. 26, 2008

(54) HOUSING DEVICE WITH FIXING MEMBER FOR PUSH BUTTON

(75) Inventors: Lei Guo, Shenzhen (CN); Xian-Lei Meng, Shenzhen (CN)

(73) Assignees: Innocom Technology (Shenzhen) Co., Ltd., Shenzhen, Guangdong Province (CN); Innolux Display Corp., Miao-Li County (TW)

( * ) Notice: Subject to any disclaimer, the term of this patent is extended or adjusted under 35 U.S.C. 154(b) by 0 days.

(21) Appl. No.: 11/641,462

(22) Filed: Dec. 19, 2006

(65) Prior Publication Data

US 2007/0144883 A1 Jun. 28, 2007

(30) Foreign Application Priority Data

Dec. 22, 2005 (CN) ..... 2005 1 0121026

(51) Int. Cl.
*H01H 9/00* (2006.01)

(52) U.S. Cl. ..... 200/296

(58) Field of Classification Search ..... 200/296, 200/341, 343
See application file for complete search history.

(56) References Cited

U.S. PATENT DOCUMENTS

| | | | | |
|---|---|---|---|---|
| 4,638,151 | A * | 1/1987 | Suwa | 235/145 R |
| 5,927,483 | A * | 7/1999 | Yamada | 200/343 |
| 6,160,232 | A * | 12/2000 | Lin | 200/341 |
| 6,842,333 | B2 | 1/2005 | Lee et al. | |
| 6,964,532 | B1 * | 11/2005 | Lu | 400/490 |
| 7,019,237 | B2 * | 3/2006 | Hong | 200/296 |
| 7,098,417 | B1 * | 8/2006 | Fuji | 200/343 |

* cited by examiner

*Primary Examiner*—Michael A Friedhofer
(74) *Attorney, Agent, or Firm*—Wei Te Chung

(57) ABSTRACT

An exemplary frame assembly (2) includes a frame (21), plural posts (212), a button member (22), and plural push buttons (222). The frame includes a bottom wall (211). The posts are formed at the bottom wall. The button member includes a fixing board (223) having plural fixing holes (225). Plural protuberances (2252) are formed on an inner wall surrounding each fixing hole. Each push button connects to the fixing board by an elastic connector (221). Each post is interferentially engaged in a corresponding fixing hole.

15 Claims, 6 Drawing Sheets

HOUSING DEVICE WITH FIXING MEMBER FOR PUSH BUTTON

FIELD OF THE INVENTION

The present invention relates to a frame assembly, and more particularly to a frame assembly having a fixing member for one or more push buttons.

GENERAL BACKGROUND

A common kind of electronic device generally includes a frame assembly for receiving a plurality of push buttons and components therein. The push buttons are adopted as an input interface with the components for adjusting characteristics of the electronic device, for example, a liquid crystal display with several push buttons for adjusting brightness, contrast ratio and resolution thereof.

Referring to FIG. 7, an exploded, back view of a frame assembly 1 with disassembled push buttons. The frame assembly 1 includes a button member 12 and a frame 11 having a receiving space (not labeled). The frame 11 includes a bottom wall 111. Four through holes 112 and four posts 113 are both formed on the bottom wall 111. The posts 113 are made from plastic that can be melted or the like.

The button member 12 includes eight elastic connectors 121, four push buttons 122, and a fixing board 123. The fixing board 123 includes four fixing holes 1234; each has a size in accordance to the post 113, are formed at positions according to the posts 113. Each of the push buttons 122 is formed at position according to the respective through hole 112, each has a size in accordance to thereof, and is connected to the fixing board 123 by two connectors 121.

The frame assembly 1 assembled with push buttons 122 is illustrated in FIG. 8. The button member 12 is received in the receiving space of the frame 11, and the push buttons 122 are arranged through the through holes 112 while the posts 113 are penetrated through the fixing holes 1234. Ends of the posts 113 protrude out from the fixing holes 1234 and are melted over the adjoining surface of the fixing board 123. Thereby, the button member 12 is fixed on the frame 11. The push buttons 122 can be operated in the front of the frame assembly 1 by pressing, and the push buttons 122 can automatic bounce back via resilience of the connectors 121 after pressing.

However, the button member 12 or other devices nearby may be damaged during the process of melting the posts 113.

Accordingly, what is needed is a frame assembly configured with a fixing means for push buttons to be easily attached with a frame assembly.

SUMMARY

An exemplary frame assembly includes a frame, plural posts, a button member, and plural push buttons. The frame includes a bottom wall. The posts are formed at the bottom wall. The button member includes a fixing board having plural fixing holes. Plural protuberances are formed on an inner wall surrounding each fixing hole. Each push button connects to the fixing board by an elastic connector. Each post is interferentially engaged in a corresponding fixing hole.

A detailed description of embodiments of the present invention is given below with reference to the accompanying drawings.

BRIEF DESCRIPTION OF THE DRAWINGS

In the drawings, all the views are schematic.

DETAILED DESCRIPTION OF PREFERRED EMBODIMENTS

Figure 1:
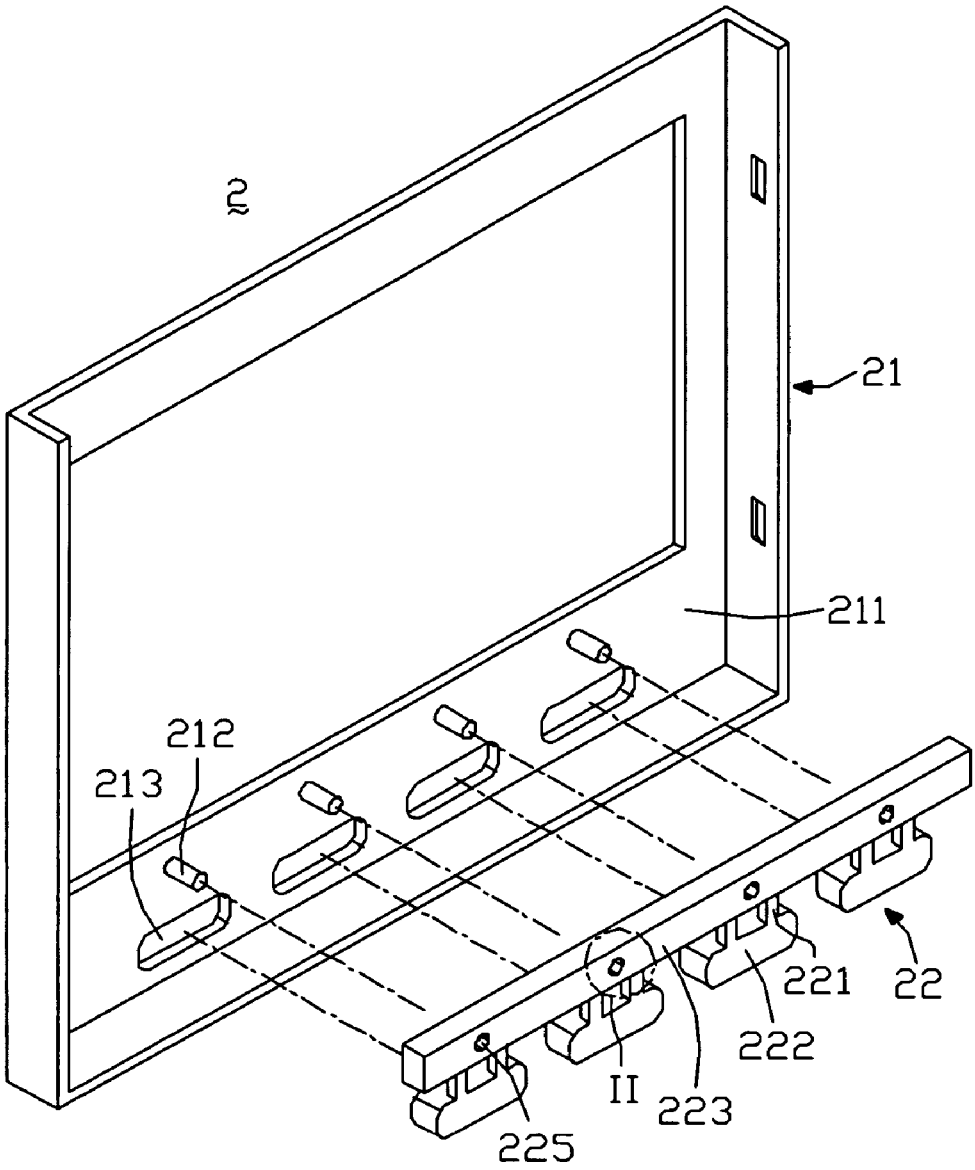
FIG. 1 is an exploded, back view of a frame assembly with disassembled push buttons in accordance with a first embodiment of the present invention.

Referring to FIG. 1, an exploded, back view of a frame assembly 2. The frame assembly 2 includes a button member 22 and a frame 21 having a receiving space (not labeled). The frame 21 includes a bottom wall 211. Four through holes 213 and four posts 212 adjacent to each other are both formed on the bottom wall 211.

The button member 22 includes eight elastic connectors 221, four push buttons 222, and a fixing board 223. The fixing board 223 includes four fixing holes 225, and the diameter of the posts 212 matches the diameter of the fixing holes 225. Each of the posts 212 is formed at position according to the respective fixing hole 225. Each push button 222 is formed at position according to the respective through hole 212 having a size in accordance to thereof. The push button 212 is connected to the fixing board 223 by two connectors 221, and the fixing holes 225 are formed at positions according to the posts 212.

Figure 2:
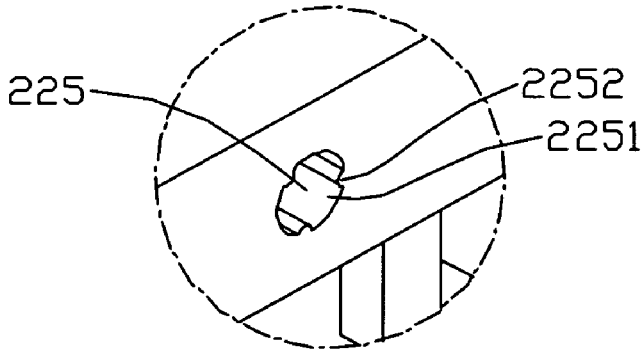
FIG. 2 is an enlarge view of the fixing hole with protuberances of FIG. 1.

Refening to FIG. 2, this shows an enlarged view of the fixing hole 225 of FIG. 1. Each fixing hole 225 is bounded by an inner wall 2251. Three elongate protuberances 2252 are formed on the inner wall 2251. The protuberances 2252 arc parallel to each other, and uniformly spaced apart. Each protuberance 2252 has a semicircular profile. Thus, each post 212 can be interferentially fixed in the corresponding fixing hole 255 tightly.

Figure 3:
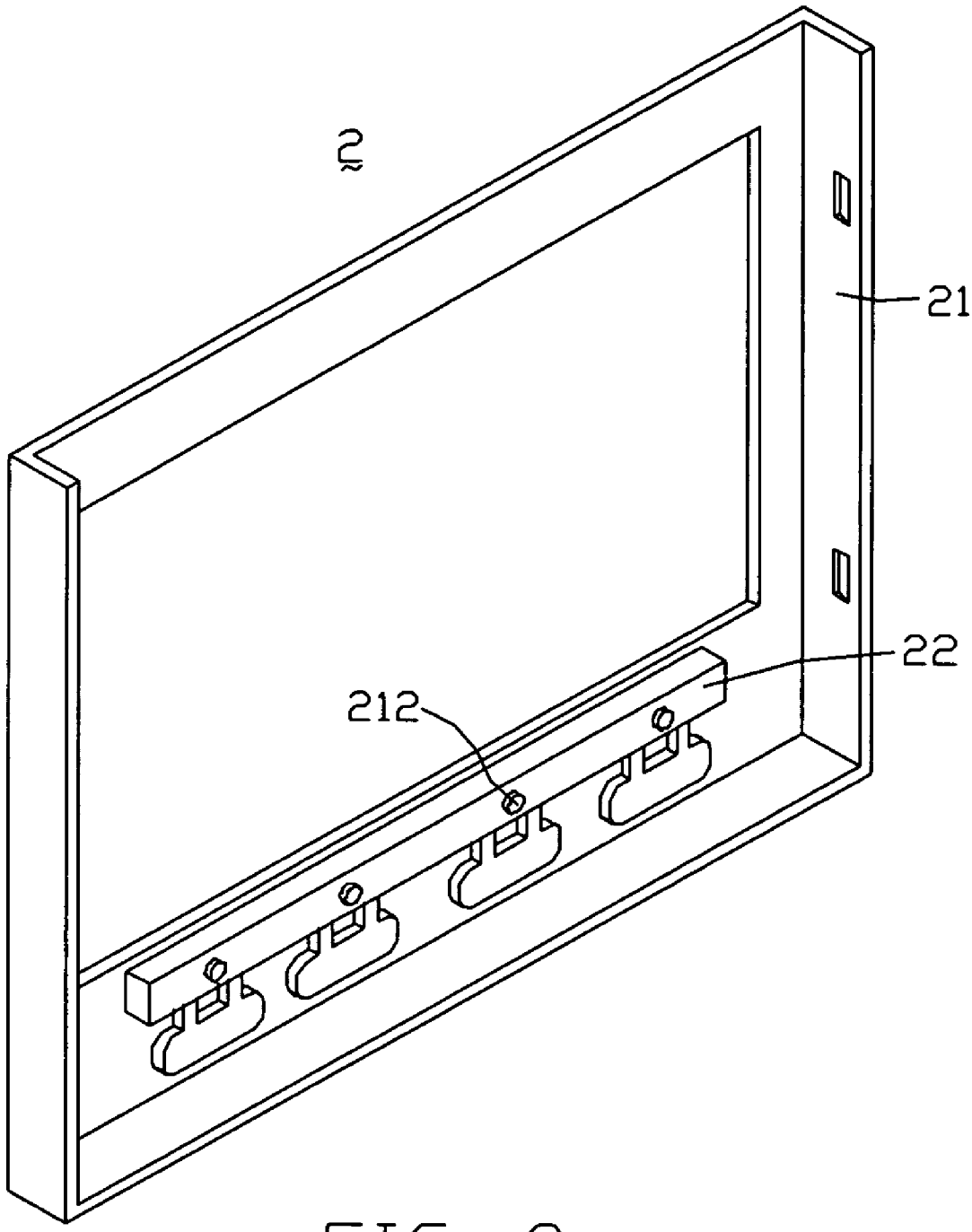
FIG. 3 is a back view of a frame assembly assembled with push buttons shown in FIG. 1.

Referring also to FIG. 3, while assembling the frame assembly 2 with the push buttons 222, the button member 22 are received in the receiving space of the frame 21, and the posts 212 are ranged in the fixing holes 225 fixing the fixing board 223 at the bottom wall 211 of the frame 21, and the buttons 222 are arranged through the through holes 213. The push buttons 222 can be operated in the front of the frame assembly 2 by pressing, and the push buttons 222 can automatic bounce back via resilience of the connectors 221 after pressing.

Figure 4:
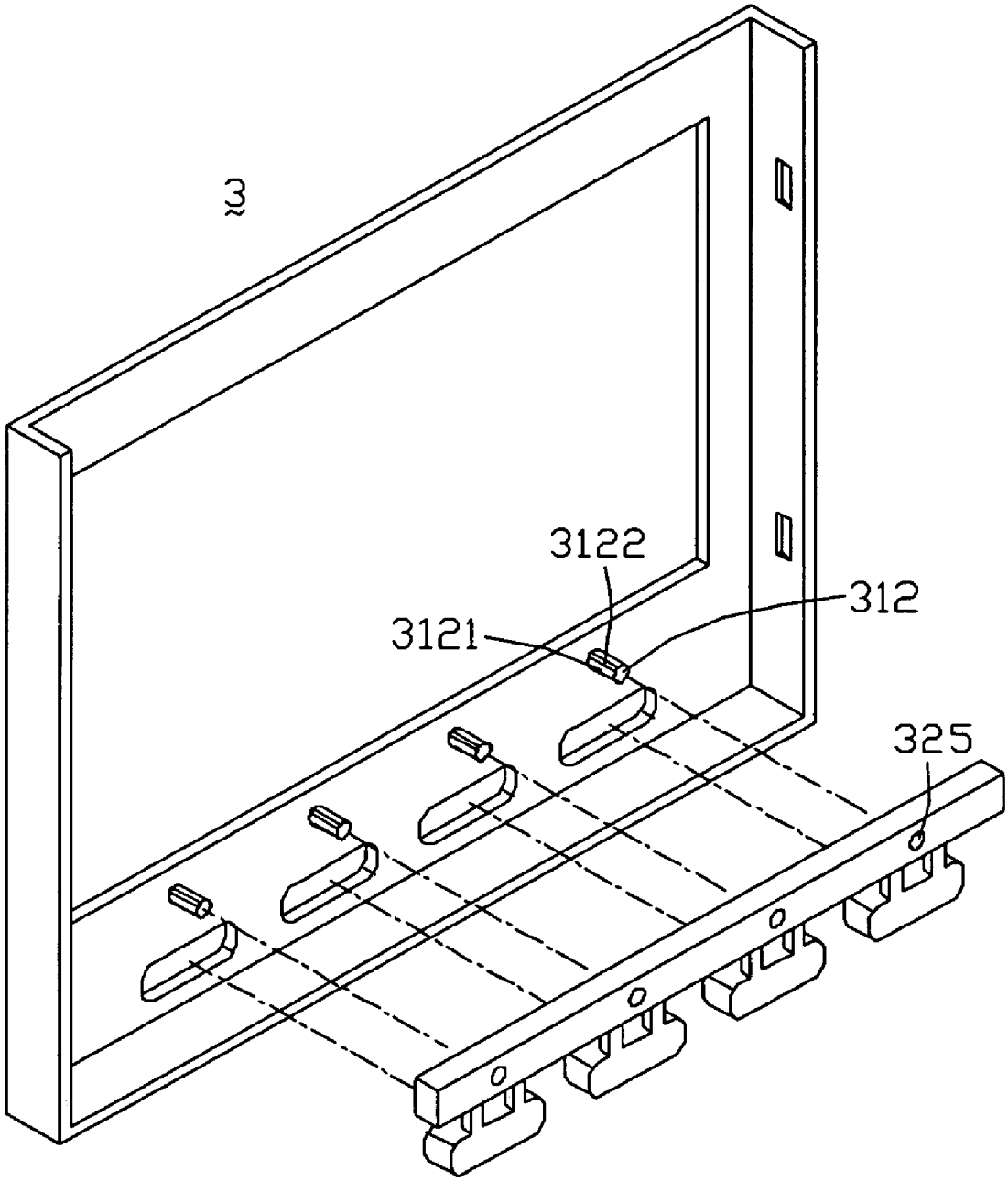
FIG. 4 is an exploded, back view of a frame assembly with disassembled push buttons in accordance with a second embodiment of the present invention.

Referring to FIG. 4, this is an exploded, back view of a frame assembly 3 disassembled with push buttons in accordance with a second embodiment of the present invention. The frame assembly 3 of the second embodiment is similar to the above-described first embodiment. The frame assembly 3 includes a frame (not labeled) having four posts 312 and a button member (not labeled). The diameter of the posts 312 matches the diameter of the fixing holes 325. Each post 312 has a surface 3121, and three elongate protuberances 3122 formed on the surface 3121. The protuberances 3122 are parallel to each other, and spaced uniformly apart. Each protuberance 3122 has a semicircular profile. Thus, the post 312 can be interferentially fixed in the corresponding fixing hole 355 tightly.

Figure 5:
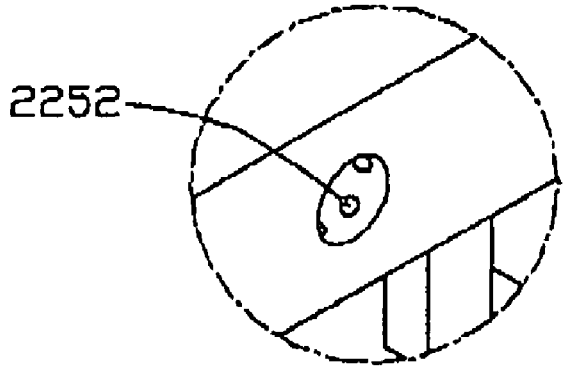
FIG. 5 is an enlarge view of an alternative fixing hole with protuberances of FIG. 1.
Figure 6:
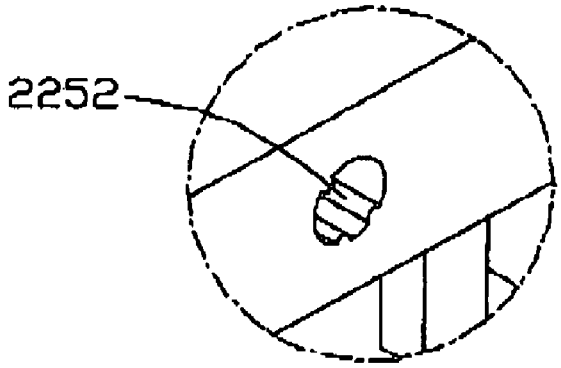
FIG. 6 is an enlarge view of another alternative fixing hole with protuberances of FIG. 1.
Figure 7:
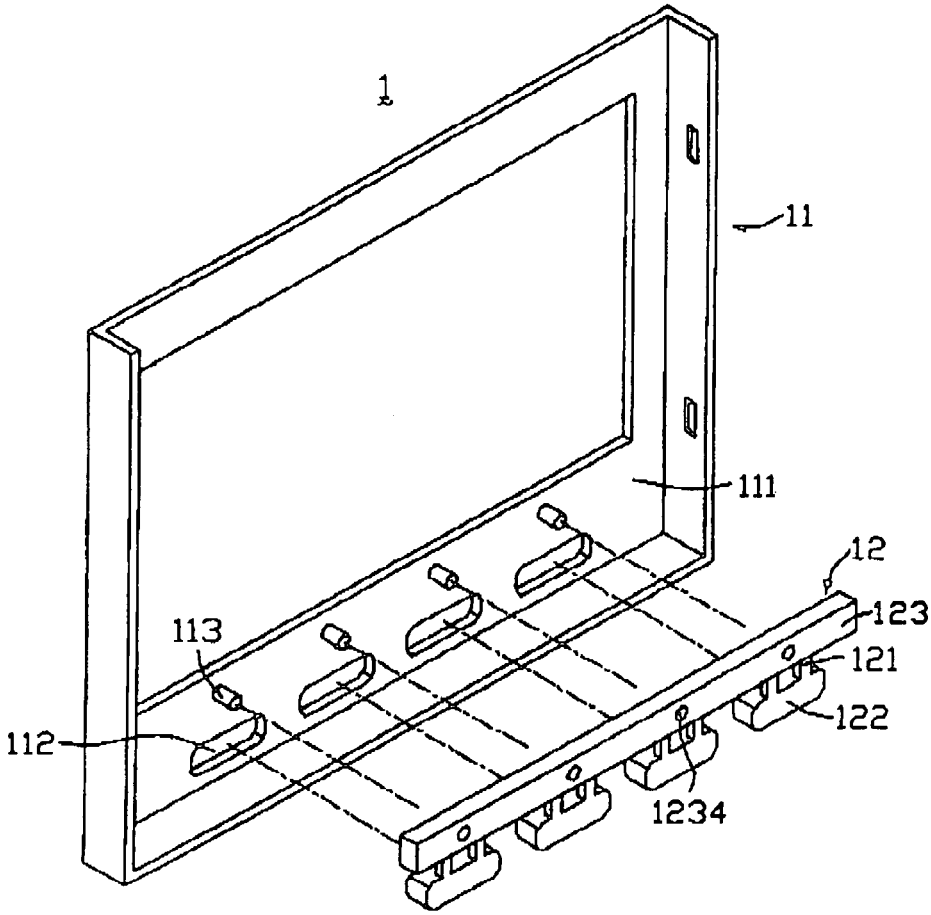
FIG. 7 (RELATED ART)
FIG. 7 is an exploded, back view of a conventional frame assembly with disassembled push buttons.
Figure 8:
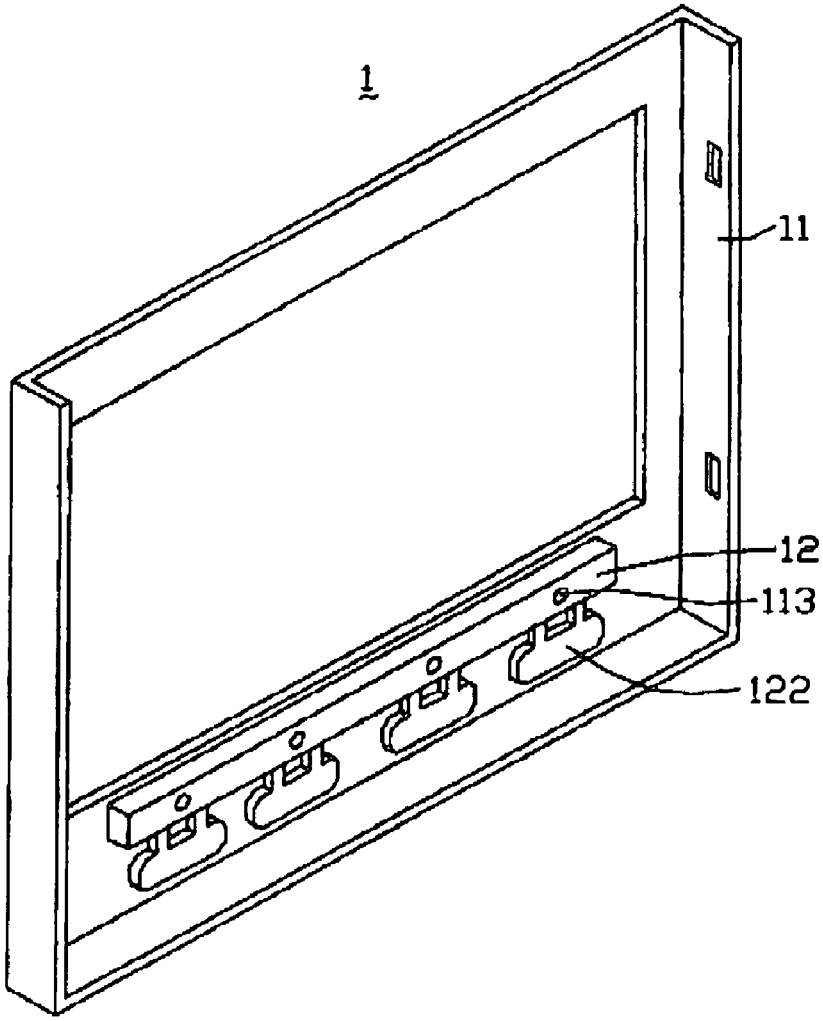
FIG. 8 (RELATED ART)
FIG. 8 is a back view of a conventional frame assembly assembled with push buttons.

In alternative embodiments, the protuberances 2252, 3122 can have other suitable configurations. For example, the protuberances 2252 (3122) can be dome-shaped dots, as shown in FIG. 5. The protuberances 2252 can be formed randomly at the inner wall 2251 of each fixing hole 225 as shown in FIG 6. The protuberances 3122 can also be formed randomly at the surface 3121 of each post 312. The number of protuberances 2252, 3122 is not limited to the numbers described above and illustrated. Each of the posts 212 can additionally have protuberances 3122 provided thereon. Put another way, each of the fixing holes 325 can additionally have protuberances 2252 provided therein. The number of protuberances 3122 in any of these various embodiments can be determined according to need.

The fixing board 223 can be taken apart from the frame assembly 2 when one of the push buttons 222 is damaged or the fixing board 223 needs replacement for some other reason. Thereby, the frame 21 remains intact for further use. The process of attaching the button member 12 with the frame 21 is simple, and costs can be reduced.

While preferred and exemplary embodiments have been described above, it is to be understood that the invention is not limited thereto. To the contrary, the above description is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A frame assembly, comprising:
a frame comprising a bottom wall;
at least one post formed at an inside of the bottom wall; and
a button member comprising a fixing board having at least one fixing hole defined therein, wherein an inner wall of the fixing board around the at least one fixing hole comprises at least one protuberance; and
at least one push button connected to the fixing board by at least one elastic connector;
wherein the at least one post is interferentially engaged in the at least one fixing hole.

2. The frame assembly as claimed in claim 1, wherein the bottom wall further comprises at least one through hole, and the at least one push button protrudes through the at least one through hole.

3. The frame assembly as claimed in claim 1, wherein a profile of the at least one protuberance is semicircular.

4. The frame assembly as claimed in claim 1, wherein the at least one protuberance is elongate.

5. The frame assembly as claimed in claim 1, wherein the at least one protuberance is a dome-shaped dot.

6. The frame assembly as claimed in claim 1, wherein the at least one protuberance is a plurality of protuberances, and the protuberances are spaced uniformly apart.

7. The frame assembly as claimed in claim 1, wherein the at least one protuberance is a plurality of protuberances, and the protuberances are located non-uniformly at the inner wall of the fixing board around the fixing hole.

8. A frame assembly, comprising:
a frame comprising a bottom wall;
at least one post formed at the bottom wall, the at least one comprising at least one protuberance;
a button member comprising a fixing board defining at least one fixing hole therein; and
at least one push button connected to the fixing board by at least one connector;
wherein the at least one post is interferentially engaged in the at least one fixing hole.

9. The frame assembly as claimed in claim 8, wherein the bottom wall further comprises at least one through hole, and the at least one push button protrudes through the at least one through hole.

10. The frame assembly as claimed in claim 8, wherein a profile of the at least one protuberance is semicircular.

11. The frame assembly as claimed in claim 8, wherein at least one protuberance is elongate.

12. The frame assembly as claimed in claim 8, wherein the at least one protuberance is a dome-shaped dot.

13. The frame assembly as claimed in claim 8, wherein the at least one protuberance is a plurality of protuberances, and the protuberances are spaced uniformly apart.

14. The frame assembly as claimed in claim 8, wherein the at least one protuberance is a plurality of protuberances, and the protuberances are located non-uniformly at the inner wall of the fixing board around the fixing hole.

15. A frame assembly comprising:
a frame comprising a bottom wall;
at least one post formed at an inside of the bottom wall; and
a button member comprising a fixing board having at least one fixing hole defined therein; and
at least one push button connected to the fixing board by at least one elastic connector;
wherein the at least one post and the at least one fixing hole are forcibly mated with other under a condition that some radial positions between an outer face of the post and an inner face of the fixing hole interfere with each other and the others are not.

* * * * *